United States Patent [19]

Chervenak

[11] 4,217,201

[45] Aug. 12, 1980

[54] INTEGRATED COAL CLEANING, LIQUEFACTION, AND GASIFICATION PROCESS

[75] Inventor: Michael C. Chervenak, Pennington, N.J.

[73] Assignee: Hydrocarbon Research, Inc., Lawrenceville, N.J.

[21] Appl. No.: 954,015

[22] Filed: Oct. 23, 1978

[51] Int. Cl.[2] ..... C10G 1/06

[52] U.S. Cl. ..... 208/8 R; 208/10

[58] Field of Search ..... 208/8 R, 10

[56] References Cited

U.S. PATENT DOCUMENTS

| | | | |
|---|---|---|---|
| 2,082,467 | 6/1937 | Prins | 209/156 |
| 2,840,462 | 6/1958 | Gorin | 208/8 R |
| 3,233,731 | 2/1966 | Nailler | 209/156 |
| 3,715,301 | 2/1973 | Tassoney et al. | 208/8 R |

*Primary Examiner*—Herbert Levine

*Attorney, Agent, or Firm*—Michael A. Jacobs

[57] ABSTRACT

Coal is finely ground and cleaned so as to preferentially remove denser ash-containing particles along with some coal. The resulting cleaned coal portion having reduced ash content is then fed to a coal hydrogenation system for the production of desirable hydrocarbon gases and liquid products. The remaining ash-enriched coal portion is gasified to produce a synthesis gas, the ash is removed from the gasifier usually as slag, and the synthesis gas is shift converted with steam and purified to produce the high purity hydrogen needed in the coal hydrogenation system. This overall process increases the utilization of as-mined coal, reduces the problems associated with ash in the liquefaction-hydrogenation system, and permits a desirable simplification of a liquids-solids separation step otherwise required in the coal hydrogenation system.

6 Claims, 2 Drawing Figures

INTEGRATED COAL CLEANING, LIQUEFACTION, AND GASIFICATION PROCESS

BACKGROUND OF THE INVENTION

This invention pertains to coal liquefaction and hydrogenation processes to provide hydrocarbon gases and liquid product streams. More particularly, it pertains to a coal hydrogenation process wherein ground coal is segregated into an ash-reduced portion which is advantageously fed to a hydrogenation system and an ash-enriched portion which is gasified and utilized to produce the hydrogen needed in the hydrogenation system.

In the known processes for the liquefaction and hydrogenation of coal to produce useful hydrocarbon gas and liquid products, it is usually necessary to remove the very fine ash particles from the resulting liquid product stream in order for it to be commercially useful either as a fuel or as a hydrocarbon feedstock for further processing. The unconvertible solids in the feed to the high pressure liquefaction step require removal by the use of hydroclones to control their concentration in the liquefaction reaction. However, this liquid-solids separation step is a difficult and expensive procedure, requiring specialized equipment. Minimizing the solids to be removed will simplify this step, and eliminating the need for hydroclones would simplify the overall process. It is also recognized that considerable high purity hydrogen is required in coal liquefaction-hydrogenation processes. To produce this hydrogen, it has been proposed to gasify additional coal.

Coal cleaning processes, such as by washing, flotation, magnetic separation, etc., are generally known and used in the coal industry to remove dirt, rock and some ash from coal, either at the mine site or sometimes at coke producing plants. For example, U.S. Pat. No. 2,082,467 to Prins and U.S. Pat. No. 3,233,731 to Nailler disclose typical coal cleaning proprocesses using water washing and flotation to remove the coal portion containing high mineral matter or ash. U.S. Pat. No. 3,463,310 to Ergun discloses a typical coal cleaning process using magnetic separation to remove pyrites. Such coal cleaning processes are usually operated so as to remove as little of the coal as possible along with the undesirable materials which are discarded.

U.S. Pat. No. 3,926,775 to Schroeder discloses a coal hydrogenation process wherein the coal is water washed and separated into low and high ash fractions, with the low ash fraction being used in a hydrogenation process and the high ash fraction being burned in a steam power plant. But apparently no coal hydrogenation process has heretofore been proposed which would effectively utilize the ash-enriched coal fraction from a coal cleaning process and allow a relatively large portion of coal to be removed from the raw coal along with the ash-enriched fraction and then gasified to produce the hydrogen needed in a liquefaction-hydrogenation system, to which the ash-reduced fraction is fed.

SUMMARY OF THE INVENTION

I have discovered an improved coal liquefaction-hydrogenation process wherein coal containing ash impurities is finely ground and then cleaned by suitable methods, such as by water washing, flotation, or magnetic separation to provide a cleaned coal portion containing reduced ash and a remaining portion containing increased ash along with some coal. The cleaned coal portion having reduced ash concentration is advantageously hydrogenated to produce desirable gases and liquid products, thereby usually simplifying or avoiding a solids-separation step for removing very fine ash particles from the recycle oil used for slurrying the coal into the reactor and lessening the amount of ash to be removed from the hydrogenated liquid product. The remaining ash-enriched coal portion is gasified to produce a synthesis gas intermediate stream, and the ash material is removed from the bottom of the gasification reactor either in dry form or as a molten slag. The resulting synthesis gas containing $H_2$ and CO is then shift reacted with steam to produce a hydrogen-enriched gas. Following its purification by removal of $CO_2$ and $H_2S$, this gas is used to supply the high purity make-up hydrogen requirements for the coal hydrogenation system.

As a result of the lower percentage ash solids in the coal feedstream to the hydrogenation reactor, particularly to an upflow ebullated catalytic bed type hydrogenation reactor, its operation is enhanced and the liquid effluent product contains a lower concentration of particulate solids. Thus, the amount of ash fines to be removed from the coal hydrogenation liquid products is greatly reduced, thereby minimizing a difficult and expensive liquid-solids separation step. It is a further advantage of this invention that the coal cleaning step can be relatively inefficient with regard to the amount of coal retained with the ash-enriched portion, as this coal is ultimately utilized in the gasification step to produce the hydrogen needed in the hydrogenation system. This combined coal hydrogenation-gasification process is useful for bituminous and semibituminous coals.

Several coal cleaning procedures in commercial use at mines or by coal users may be used in this invention, including wet washing with water or with other fluids selected to have appropriate certain specific gravity ranges, pneumatic cleaning, and magnetic separation processes. However, the coal cleaning method presently preferred for this process is water washing.

When water washing of the coal is used, only the cleaned coal portion need be dried of surface moisture before feeding the coal to the hydrogenation reaction zone. The remaining coal portion containing increased concentration of ash if fed wet to the gasification reactor, where the water remaining in the coal serves to reduce the quantity of steam needed to be supplied to control the gasification temperatures therein.

The cleaned ash-reduced coal portion is dryed and slurried with a hydrocarbon oil made in the system, then pressurized to at least 500 psi, preheated to at least 500° F. and passed with hydrogen into a hydrogenation reaction zone at elevated temperature and pressure conditions. Here the coal slurry is converted to lower boiling hydrocarbon liquids and gas products. The hydrogenation zone is preferably a catalytic upflow ebullated bed reaction zone as described by Keith et al in U.S. Pat. No. 3,519,555, which is incorporated herein by reference. Because of the reduced concentration of ash present in the coal feedstream to the hydrogenation reactor, the resulting heavy hydrocarbon liquid product will contain a correspondingly reduced amount of fine ash solids, with the result that less solids need be removed in the liquid-solids separation step.

The coal portion containing an increased concentration of ash and sulfur-containing solids is passed to a fluidized bed gasification zone along with pressurized oxygen and steam. Pressure in the gasification zone is at least about 50 psig and preferably 100–800 psig. A gasification temperature of about 1800° F. can be used, which permits the ash residue to be withdrawn as dry solids. However, the gasification temperature is preferably maintained sufficient to cause softening of the ash, such as above about 2000° F. Thus, the ash can be withdrawn from the lower end of the gasification zone either as dry particles or as a molten slag material. An example of a suitable coal gasification reactor is described by U.S. Pat. No. 3,715,301, which is incorporated herein by reference.

DESCRIPTION OF PREFERRED EMBODIMENT

Figure 1:
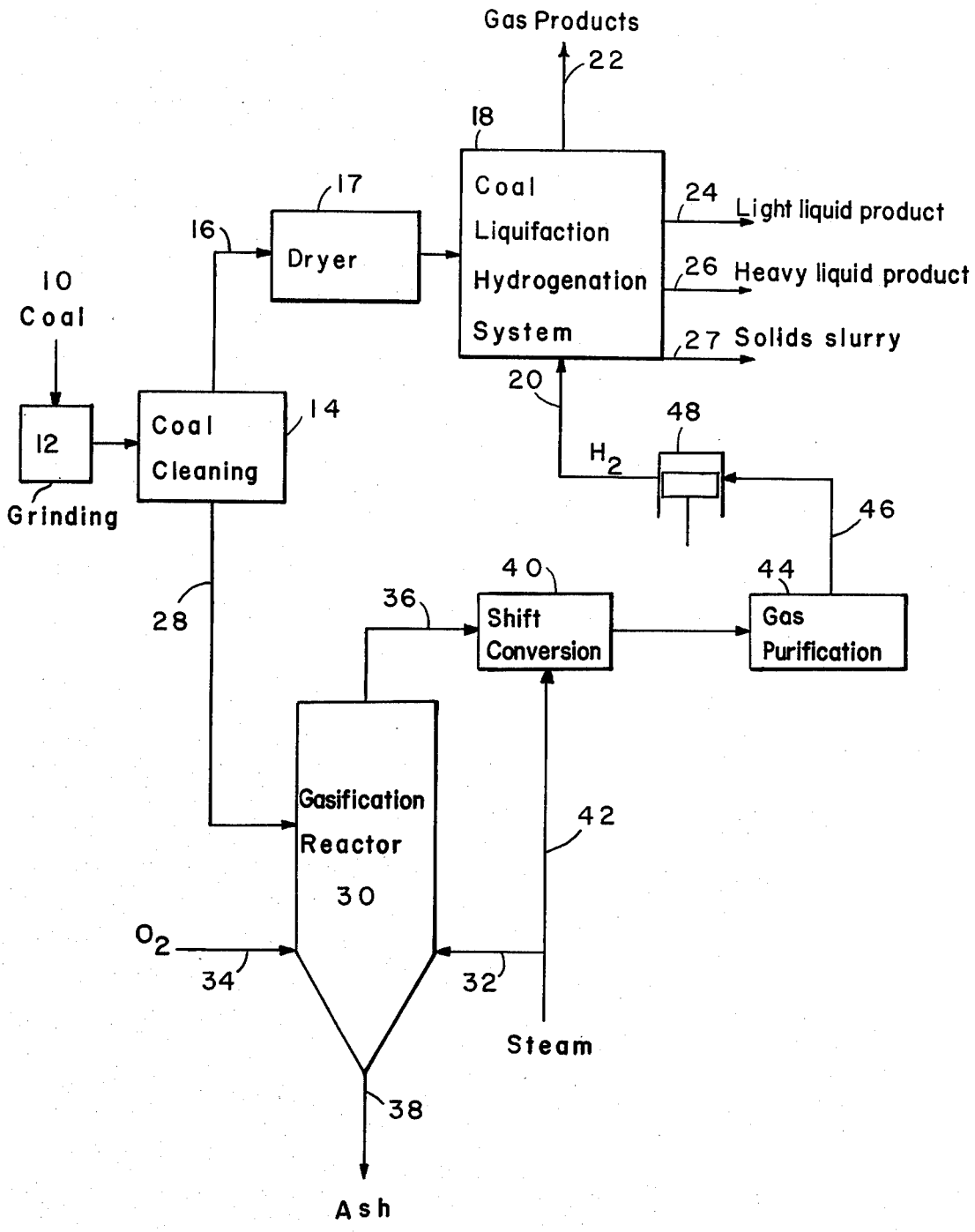
FIG. 1 is a schematic flow diagram showing the essential steps of the invention.

As shown in FIG. 1, coal such as bituminous, subbituminous or lignite at 10 is crushed or ground at 12 to an appropriate mesh size range of about 20 mesh or smaller, and then passed to a coal cleaning step at 14. Here the coal is cleaned by suitable known means such as water washing or flotation or a combination thereof such as disclosed by U.S. Pat. No. 3,233,731 to Nailler, to produce an ash-reduced portion and an ash-enriched portion. The preferred coal cleaning procedure is water washing using jig or flotation trough means, as the resulting wet coal ash-enriched portion can be efffectively utilized in the subsequent gasification step.

An ash-reduced coal portion 16 is first passed to a drying step at 17 and then to a coal liquefaction and hydrogenation system at 18, along with high purity hydrogen added at 20. The hydrogenation system preferably comprises a upflow catalytic ebullated bed reactor as described by U.S. Pat. No. 3,519,555 to Keith et al. Because of the reduced ash impurities in the feedstream to the hydrogenation step a hydroclone system such as described in U.S. Pat. No. 3,540,995 to Wolk et al is not required for controlling the ash concentration in the reactor, and problems associated with handling high ash-containing liquids are minimized. A gaseous product is withdrawn from the hydrogenation step at 22, a light liquid product at 24, a heavy liquid product is withdrawn at 26, and a slurry stream containing some unreacted coal solids or char and ash is withdrawn at 27 as residue.

An ash-enriched coal portion 28 is withdrawn from coal cleaning step 14 and is fed to gasification zone 30 along with steam at 32 and oxygen-enriched gas at 34 as needed. The heavy liquid residue 27 will usually also be fed to the gasification zone 30. The gasification process occurs at least about 1800° F. temperature and pressure at least about 50 psig and preferably 100–800 psig to produce a synthesis gas stream 36. The ash is withdrawn at 38, usually in molten slag form. A suitable coal gasification reactor is described in U.S. Pat. No. 4,099,933 to Johnson et al, which is incorporated herein by reference.

The synthesis gas 36 containing principally $H_2$ and CO is shift converted in converter 40 with steam at 42 in the presence of suitable catalyst to convert the CO to additional hydrogen and $CO_2$. The hydrogen-enriched gas is then purified at 44 for substantial removal of $CO_2$ and $H_2S$, and the resulting high purity hydrogen at 46 is pressurized at 48 to at least 500 psig and usually 1000–3000 psig to provide hydrogen make-up stream 20.

This invention will be further illustrated by reference to the following example, which should not be construed to the limiting in scope.

EXAMPLE

Figure 2:
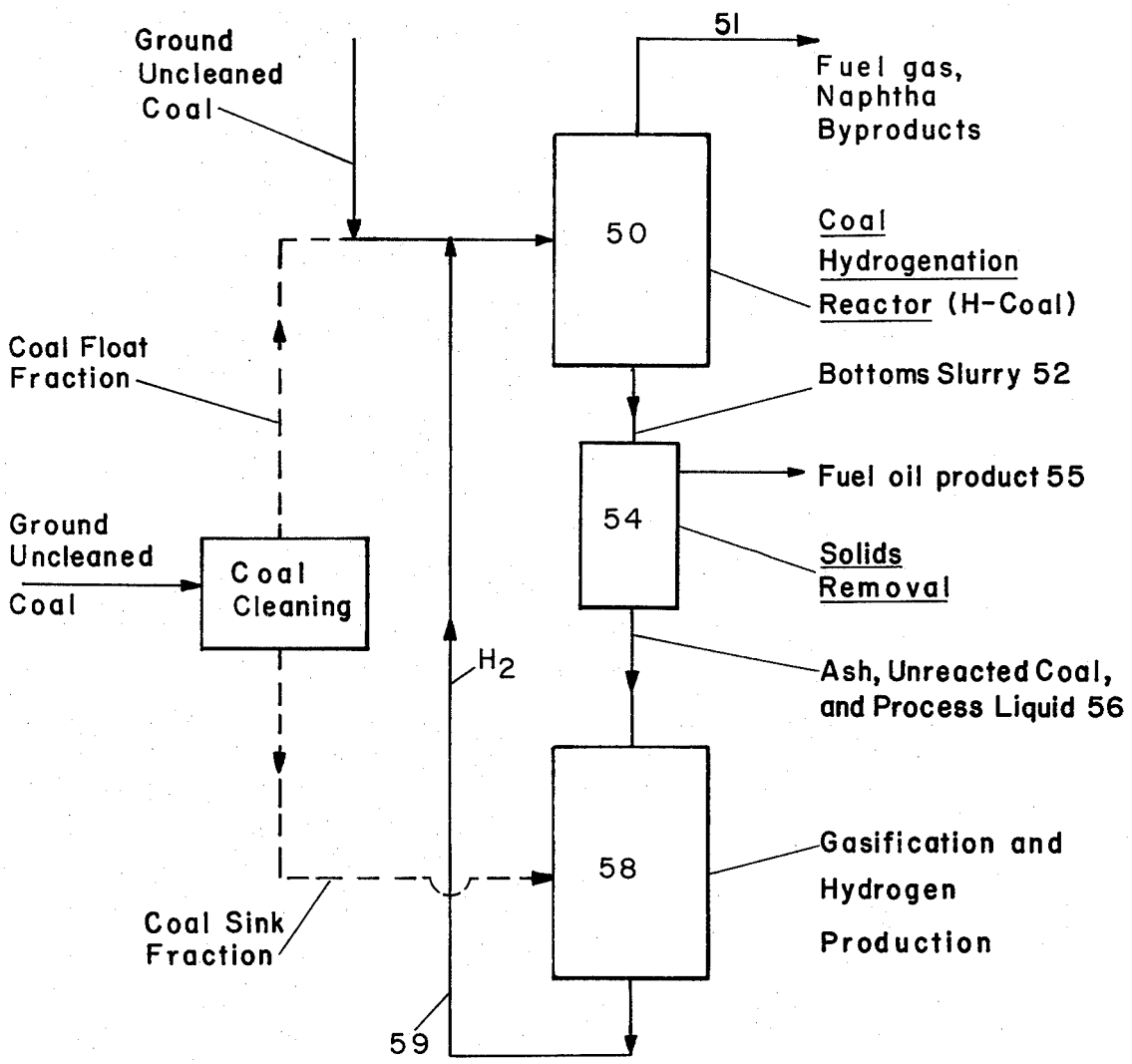
FIG. 2 is a simplified schematic flow diagram showing the principal conventional coal hydrogenation steps as compared with using coal cleaning per this invention.

In an operation which is illustrated schematically in FIG. 2, a bituminous coal containing 10.3% W% ash is normally processed by catalytic hydrogenation in the H-Coal process reactor 50 at about 850° F. and 1800 psi hydrogen partial pressure to produce fuel oil, naphtha, and fuel gas at 51. In this arrangement, bottoms product slurry 52 from the hydrogenation reactor containing heavy distillates, residuum oil, unreacted coal, and ash is sent to a solids separation settler step 54, which provides a substantially solids-free fuel oil product as the overhead stream 55 and a solids concentrated pumpable slurry bottoms stream 56. The bottoms material is used as feed for hydrogen manufacture system 58, such as by the Texaco partial oxidation process.

The alternative mode of operation in accordance with this invention is to clean the coal feed such as by washing the coal by flotation at 60 to provide a float portion 62 having about 1.5 specific gravity and containing 6.83 W% ash, and a sink fraction 64 containing 38.0 W% ash. For this coal there is 88.9% in the light float fraction which is processed in the H-Coal hydrogenation system as before, and which will have only 59% as much ash to be removed in the solids settling systems as compared to the base case, and a reduced proportion of heavy oil is sent with this ash as slurry feed to the hydrogen production step. The sink fraction of coal, amounting to 11.1% of the original coal, is sent directly to hydrogen production at 58 and hydrogen stream 59 is returned to coal hydrogenation reactor 50. The alternative mode operation is indicated as dashed flow lines in FIG. 2.

Table 1 compares the important features of these two modes of coal hydrogenation operations, based on feeding one ton (2000 pounds) of raw coal. With cleaning of the coal by washing and hydrogenation of the float fraction in accordance with this invention, there is an increase in product liquids made by 1%, the required ash removal from the hydrogenation liquid products is reduced by 41% and the hydrogen manufacture requirement is lowered by 7.5%, all based on coal feed, as compared to the base case with unclean coal.

TABLE 1

| | Base Case | With Coal Cleaning |
|---|---|---|
| Net Coal to Hydrogenation Process, Pounds | 2,000 | 1,778 (Float) |
| Coal from Cleaning, Pounds | — | 222 (Sink) |
| Ash, W% | | |
| Coal to Hydrogenation Process | 10.30 | 6.83 |
| Coal from Cleaning | — | 38.00 |
| Process Yields: | | |
| Fuel Gas, SCF | 883 | 815 |
| Naphtha, Barrel | 0.857 | 0.791 |
| Fuel Oil, Barrels | 1.880 | 1.970 |
| Total Liquids, Barrels | 2.737 | 2.761 |
| Ash Removal from Products, Pounds | 206.0 | 121.4 |
| Hydrogen Required, SCF | 18,450 | 17,060 |
| Feed to Hydrogen Production, Pounds | | |
| Process Liquids | 384.1 | 268.3 |
| Unreacted Coal from Process | 138.5 | 114.4 |
| Organic Matter in Sink Coal | — | 137.6 |

TABLE 1-continued

| | Base Case | With Coal Cleaning |
|---|---|---|
| Total | 522.6 | 520.31 |

While I have shown and described a preferred embodiment of my invention, it is understood that modifications may be made thereto within the scope and spirit of the disclosure and as defined by the following claimes.

What is claimed is:

1. A coal hydrogenation process for producing hydrocarbon gas and liquid product streams, comprising the steps of:

(a) grinding the coal to smaller than about 20 mesh;

(b) cleaning the particulate coal so as to form an ash-reduced portion and an ash-enriched portion;

(c) feeding the ash-reduced coal portion to a liquefaction-hydrogenation reaction zone with hydrogen to produce hydrocarbon gas, a liquid product stream, and a heavy liquid residue slurry stream containing unreacted coal and ash;

(d) gasifying the ash-enriched coal portion in a gasification zone to produce a synthesis gas containing principally $H_2$ and CO;

(e) withdrawing ash from the coal gasification zone;

(f) shift converting the synthesis gas with steam to produce an enriched hydrogen gas stream;

(g) removing $CO_2$ and $H_2S$ impurities from the enriched hydrogen stream and purifying same to form a high purity hydrogen stream;

(h) passing the high purity hydrogen gas to the hydrogenation reaction zone to provide the high purity make-up hydrogen needed at (c); and (i) withdrawing hydrocarbon gas and liquid products from the hydrogenation reaction zone.

2. The process of claim 1, wherein cleaning of the ground particulate coal is accomplished by water washing means to produce an ash-reduced float portion and an ash-enriched sink portion.

3. The process of claim 1, wherein the solids-containing liquid residue stream from hydrogenation step (c) is passed to the gasification zone along with the ash-enriched coal portion.

4. The process of claim 1, wherein the ash-enriched coal portion and liquid residue stream from step (c) are sufficient feed to produce all the make-up high purity hydrogen requirement for the hydrogenation reaction zone.

5. The process of claim 1, wherein the ash material is withdrawn from the gasification zone in molten slag form.

6. The process of claim 2, wherein the washed ash-reduced coal portion is passed through a drying step before being fed to the hydrogenation reaction zone.

* * * * *